United States Patent [19]

Poe

[11] 4,183,564

[45] Jan. 15, 1980

[54] EXTERNALLY ACCESSIBLE ADJUSTER FOR FLUSH LATCHES

[75] Inventor: L. Richard Poe, Long Beach, Calif.

[73] Assignee: Hartwell Corporation, Placentia, Calif.

[21] Appl. No.: 882,173

[22] Filed: Mar. 1, 1978

[51] Int. Cl.[2] ..... E05C 5/00

[52] U.S. Cl. ..... 292/113; 292/DIG. 31

[58] Field of Search ..... 292/113, 341.18, 158, 292/139, 341.19, 340, DIG. 31

[56] References Cited

U.S. PATENT DOCUMENTS

| | | | |
|---|---|---|---|
| 1,119,321 | 12/1914 | Schmidgall | 292/341.18 |
| 1,250,574 | 12/1917 | Ferris | 292/113 |
| 2,089,163 | 8/1937 | Hansen | 292/341.18 |
| 2,710,214 | 6/1955 | Summers | 292/113 X |
| 2,712,955 | 7/1955 | Andrews | 292/113 |
| 2,732,238 | 1/1956 | Dornberg | 292/341.18 X |
| 2,904,141 | 9/1959 | Henrichs | 292/341.18 X |
| 3,664,696 | 5/1972 | Poe | 292/DIG. 31 X |
| 4,025,096 | 5/1977 | Geer | 292/341.18 X |
| 4,040,326 | 8/1977 | Breed | 151/14 CS |

FOREIGN PATENT DOCUMENTS

| | | | |
|---|---|---|---|
| 461014 | 12/1949 | Italy | 292/341.18 |

*Primary Examiner*—J. Franklin Foss

*Attorney, Agent, or Firm*—Lyon & Lyon

[57] ABSTRACT

An externally accessible adjuster, particularly suited for adjusting the tension of a keeper shaft as applied to a hook type latch forming a part of a flush type latch assembly, the keeper shaft being screwthreaded and receiving a screwthreaded wheel having a set of radiating slots exposed in sequence through an access opening formed in the wall of the structure utilizing the flush type latch assembly. Two embodiments are illustrated, either one of which may use an opening which may be arranged to receive the latch handle, or a separate opening; also, either adjuster may be arranged to utilize a helically coiled frictional element or a yieldable detent.

5 Claims, 7 Drawing Figures

EXTERNALLY ACCESSIBLE ADJUSTER FOR FLUSH LATCHES

BACKGROUND

Flush type latch assemblies are used extensively on aircraft for receiving flush mounted hinged or removable panels. Such panels are subject to substantial, even excessive, stress and care must be taken that each latch assembly is properly adjusted to take its share of the load. Usually adjustment has required unfastening the latch assembly, making an adjustment, then relatching the assembly, a time consuming and not always dependable procedure. Special latch assemblies have been developed wherein the latch arm is externally accessible for adjustment..

SUMMARY

The present invention is directed to an externally accessible adjuster for the latch keeper rather than the latch itself, and is summarized in the following objects:

First, to provide a latch keeper adjuster which is externally accessible and may be adapted for use with a variety of standard latch assemblies.

Second, to provide a latch keeper adjuster, as indicated in the preceding object, which is capable of being installed as a replacement for a conventional keeper, the latch assembly requiring little if any alteration.

Third, to provide a latch keeper adjuster wherein the keeper shaft is screwthreaded and a screwthreaded wheel having radial tool receiving slots is fitted thereon and axially restrained by a fixed housing, the slots being accessible through a small access opening provided in the adjacent structure.

Fourth, to provide a flush latch keeper adjuster, an embodiment of which may be sufficiently compact that an adjustment tool may be inserted through the latch handle opening when the latch handle is in its initial open position while the latch hook is still in engagement with the keeper.

BRIEF DESCRIPTION OF THE FIGURES

FIGS. 1 through 4 are directed to a first embodiment in which:

FIG. 1 is a side view of a conventional flush type latch set in a surrounding surface, the latch lever of the latch structure shown attached to the externally accessible adjuster constituting the present invention.

FIG. 2 is an enlarged sectional view thereof taken through 2—2 of FIG. 1 with adjacent portions of the aircraft structure shown fragmentarily.

FIG. 3 is an enlarged sectional view taken through 3—3 of FIG. 2, the surrounding structure being omitted.

FIG. 4 is a bottom view taken from 4—4 of FIG. 3.

FIGS. 5 through 7 are directed to a second embodiment, in which:

FIG. 5 is an enlarged fragmentary sectional view taken through 5—5 of FIG. 6.

FIG. 6 is an enlarged fragmentary sectional view taken through 6—6 of FIG. 5.

FIG. 7 is an enlarged end view with a portion of the supporting means shown fragmentarily and in section.

DETAILED DESCRIPTION

Figure 1:
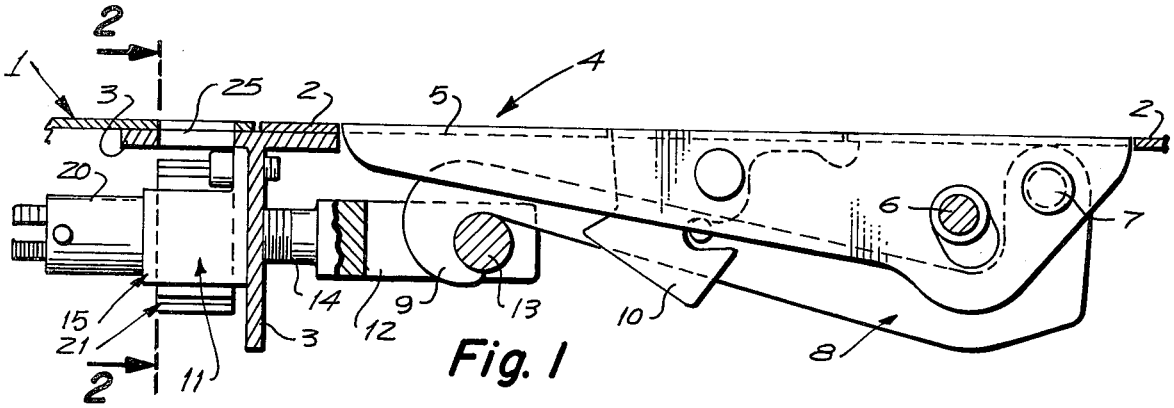
Figure 2:
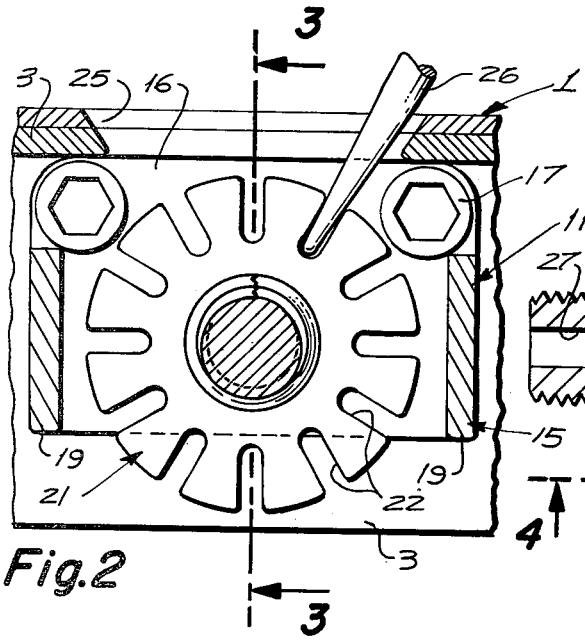
Figure 3:
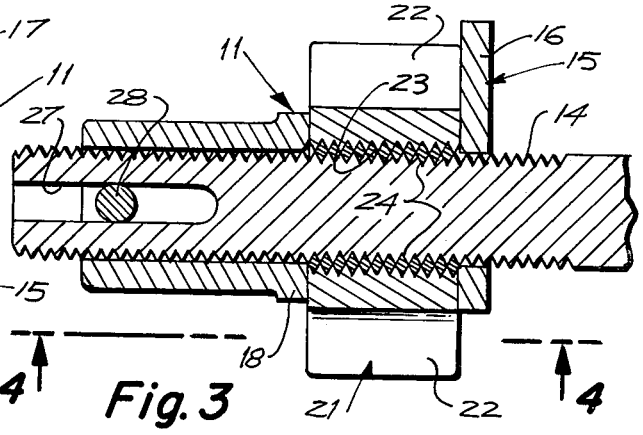
Figure 4:
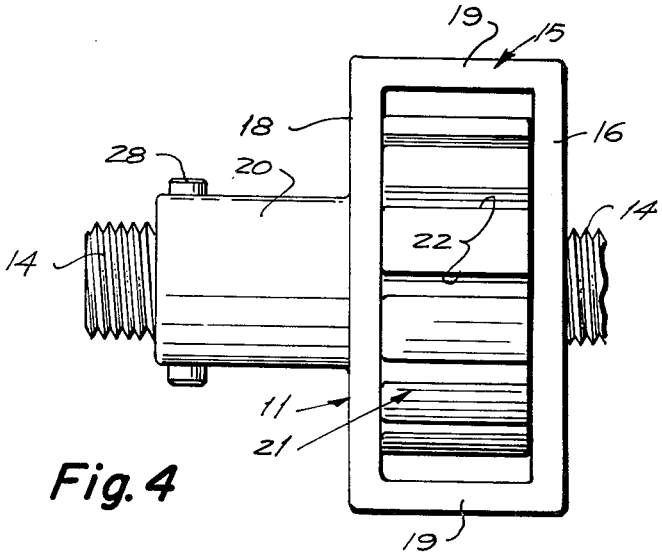

The externally accessible adjuster for flush latches is particularly adapted for use on aircraft represented fragmentarily by surface structure 1 in which is set a panel 2 supported in a surrounding frame 3.

The externally accessible adjuster may be adapted for use with a variety of latch assemblies. The latch assembly herein illustrated is essentially that shown in U.S. Pat. No. 2,712,955. However, a wide variety of flush type hook latches may be used; for example, but not limited to, the flush type latches shown in U.S. Pat. Nos. 2,894,777; 2,904,141; 3,318,624; 3,503,642; 3,515,422; and 3,542,410.

The selected latch assembly designated 4 includes a handle 5 adapted to occupy a flush position in the panel 2. The handle is pivoted about a journal pin 6 so that it may be moved between a flushed closed position and an angular position for manual engagement. Connected to the handle 5 by a journal pin 7 is a latch arm 8 having a hook end 9. When in the flush position, the handle 5 and latch arm 8 are joined together by a flush type linking latch 10 carried by the handle 5 and adapted to secure the handle and latch arm 8 when the latch assembly is in its closed position shown in FIG. 1. The linking latch 10 is manually engagable for releasing the handle.

One embodiment of the adjuster for flush latches is shown in FIGS. 1 through 4 and includes an adjuster assembly 11 having a keeper 12 which is U-shaped and provided with a cross pin 13 positioned for engagement with the hook end 9 of the latch arm 8. Extending from the keeper 12 is a screwthreaded shaft 14 which extends through the adjacent portion of the frame 3.

Mounted on the frame 3 is a housing 15 in the form of a rectangular frame and including a base plate 16 secured by screws 17 to the frame 3. Spaced from the base plate 16 is a parallel plate 18 which is joined to the base plate 16 by end walls 19. Extending from the plate 18 is a sleeve 20. The shaft 14 extends between the plates 16 and 18 and through the sleeve 20.

Received between the base plate 16 and parallel plate 18 is a tension adjustment wheel 21 having radial slots 22. The wheel 21 is provided with a screwthreaded bore 23 which does not directly engage the screwthreaded shaft 14 but instead a helical wire coil 24 is interposed which coil provides a predetermined degree of friction between the wheel and the shaft.

The coil 24 may be the type known commercially as "Heli Coil". It should be noted, however, that other conventional friction means may be provided between the wheel and shaft or between the wheel and the housing.

It will be noted in FIG. 1 that the wheel is in close proximity to the surface of the aircraft structure and is made externally accessible by a small aperture 25 through which a screwdriver 26 or other similar tool may be inserted to engage the radial slots 22. Sequential engagement of the slots may rotate the wheel in either direction so as to advance or retract the shaft 14. In order to prevent rotation of the shaft, the shaft is provided with an axial slot 27 which receives a cross pin 28 anchored in the sleeve 20.

Figure 5:
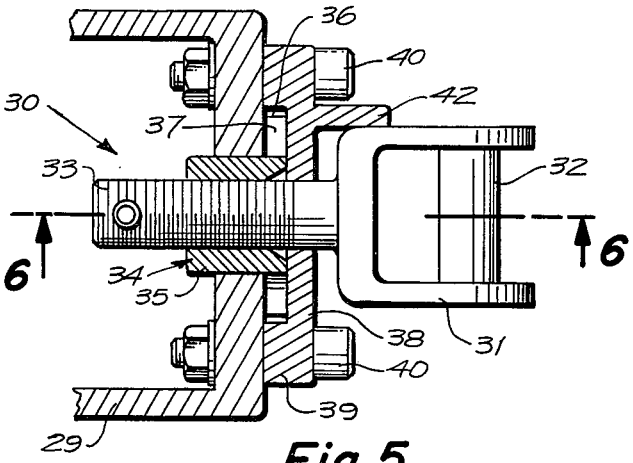
Figure 7:
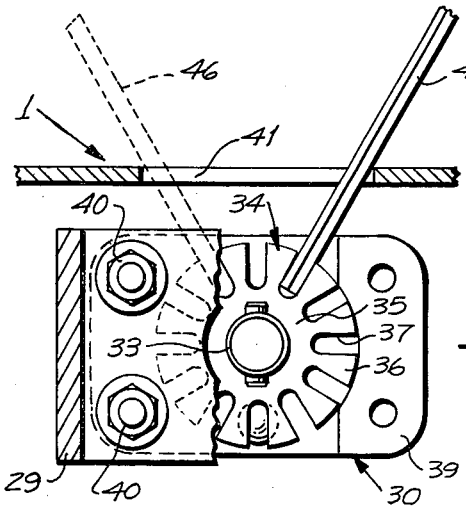
Figure 6:
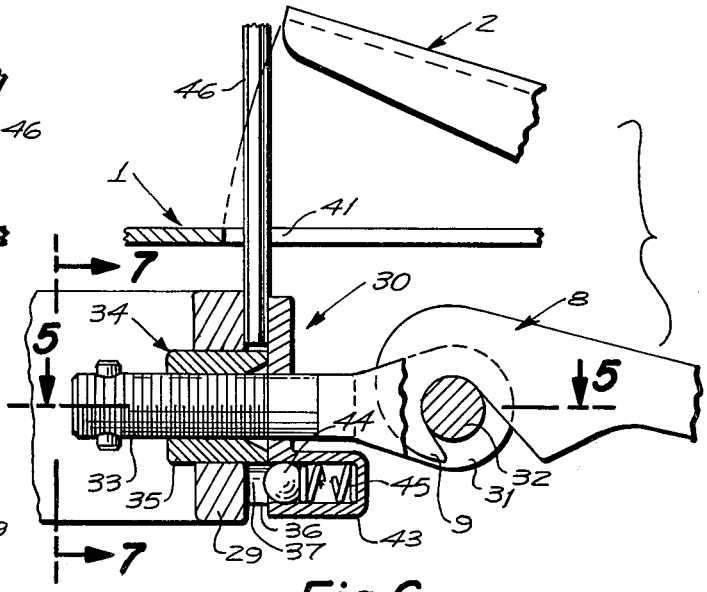

The second embodiment of the adjuster for flush latches is shown in FIGS. 5 through 7 and utilizes the surface structure 1 and handle 2 previously described; however, a conventional frame member 29 is utilized in place of the surrounding frame 3. This embodiment of the adjuster for flush latches utilizes the latch assembly 4 and the components thereof as previously described.

The adjuster includes an adjuster assembly 30 having a U-shaped keeper 31 provided with a cross pin 32 and a screwthreaded shaft 33 similar except for proportions to the first described keeper.

The shaft 33 receives a tension adjustment wheel 34 having an internally screwthreaded sleeve 35 having a flanged end 36 provided with radial slots 37, and in this respect is similar to the sleeve 20 and tension adjustment wheel 21. A base plate 38 is received on the shaft 33 adjacent to the keeper 12. The base plate 38 includes laterally spaced raised portions 39 between which is positioned the flanged end 36 of the tension adjustment wheel 34.

The raised portions 39 engage the frame member 29 so that the flanged end 36 is freely rotatable but is axially restrained with respect to the base plate 38. Screws 40 secure the base plate to the frame member. The flanged end 36 is positioned in a plane disposed adjacent an end of the panel opening 41 which receives the handle 5. To prevent rotation of the shaft 33 and keeper 31, the base plate 38 is provided with an extension 42. The base plate is provided with an axially extending detent socket 43 which receives a detent ball 44 backed by a spring 45 and positioned to engage the radial slots 37.

Operation of the embodiment of the adjuster for flush latches shown in FIGS. 5, 6 and 7 is as follows:

The standard type of flush latch is so arranged that the handle 5 is capable of limited rotational movement without altering the connection between the latch arm 8 and the keeper cross pin 32. This is accomplished by releasing the linking latch 10. As shown in FIG. 6, this initial angular movement of the handle 5 pivots it away from the end of the opening. The flanged end 36 of the adjustment wheel 34 is so positioned as to be readily accessible so that a turning tool may be inserted adjacent the end of the opening 41. The turning tool may be a conventional Allen wrench 46. Arcuate motion of the turning tool may be accomplished as indicated in FIG. 7. Such movement advances or retracts the shaft 33. In use, the tension adjustment wheel 34 is not subject to rotational force; therefore, the ball detent 44 secures the adjustment which is made in increments of the spacing between the radial slots 37. To prevent excess movement of the shaft 33, a cross pin stop 47 may be provided.

Having fully described my invention, it is to be understood that I am not to be limited to the details herein set forth, but that my invention is of the full scope of the appended claims.

I claim:

1. The combination with a flush type latch structure mounted in a panel set flush in a surrounding surface structure, an underlying mounting means, and an access opening adjacent the mounting means, the latch structure including a handle member movable in a clearance opening between a flush position and an angular position with respect to the panel, and a latch arm, of an adjustable keeper assembly, comprising:

a. a keeper element removably attached to the latch arm;

b. a screwthreaded shaft extending from the keeper element;

c. a guide means receiving the shaft and secured to the mounting means;

d. a wheel screwthreaded on the shaft and axially restrained by the guide means, the wheel having a ring of radially extending slots accessible in sequence through the access opening by a turning tool, whereby the wheel may be turned to advance or retract the keeper and latch arm while interengaged, said wheel having internal screwthreads spaced from the screwthreads of said shaft; and e. frictional means for advancing or retracting the keeper and latch arm by rotating said wheel, said frictional means being positioned between said wheel and said internal shaft screwthreads.

2. A keeper assembly, as defined in claim 1, wherein:

a. the ring of slots are disposed under the extended end of the handle member, and utilize as the access opening the corresponding end of the handle member clearance opening.

3. A keeper assembly, as defined in claim 1, wherein:

a. means is provided to restrain the shaft and wheel against relative movement when the wheel is disengaged.

4. The keeper assembly claimed in claim 1 wherein said frictional means is further defined as a helical coil.

5. The combination with a flush type latch structure mounted in a panel set flush in a surrounding surface structure, an underlying mounting means, and an access opening adjacent the mounting means, the latch structure including a handle member movable in a clearance opening between a flush position and an angular position with respect to the panel, and a latch arm, of an adjustable keeper assembly, comprising:

a. a keeper element removably attached to the latch arm;

b. a screwthreaded shaft extending from the keeper element;

c. a guide means receiving the shaft and secured to the mounting means;

d. a wheel screwthreaded on the shaft and axially restrained by the guide means, the wheel having a ring of radially extending slots accessible in sequence through the access opening by a turning tool, whereby the wheel may be turned to advance or retract the keeper and latch arm while interengaged, said wheel having internal screwthreads spaced from the screwthreads of said shaft; and e. helical coil frictional means for advancing or retracting the keeper and latch arm by rotating said wheel, said frictional means being positioned between said wheel and said internal shaft screwthreads.

* * * * *